US008932689B2

(12) United States Patent
Wei

(10) Patent No.: US 8,932,689 B2
(45) **Date of Patent: *Jan. 13, 2015**

(54) ARTIFICIAL CHRISTMAS TREE CONNECTION STRUCTURE

(75) Inventor: Chun Ting Wei, Shenzhen (CN)

(73) Assignee: Holiday Designs Crafts Shenzhen Ltd., Shenzhen, Guangdong (CN)

( * ) Notice: Subject to any disclaimer, the term of this patent is extended or adjusted under 35 U.S.C. 154(b) by 225 days.

This patent is subject to a terminal disclaimer.

(21) Appl. No.: 13/405,196

(22) Filed: Feb. 24, 2012

(65) Prior Publication Data

US 2012/0219732 A1 Aug. 30, 2012

(30) Foreign Application Priority Data

Feb. 25, 2011 (CN) ..... 2011 2 0048550 U

(51) Int. Cl.
*A47G 33/06* (2006.01)

(52) U.S. Cl.
CPC ..... *A47G 33/06* (2013.01)
USPC ..... 428/20; 428/18

(58) Field of Classification Search
None
See application file for complete search history.

(56) References Cited

U.S. PATENT DOCUMENTS 6,116,563 A * 9/2000 Tsai ..... 248/512

* cited by examiner

*Primary Examiner* — Adam Krupicka
(74) *Attorney, Agent, or Firm* — Raymond Y. Chan; David and Raymond Patent Firm

(57) ABSTRACT

An artificial Christmas tree connection structure includes a branch connection base and branch shaft units, the branch connection base coupled at a tubular main trunk body, the branch shaft units being selectively adjusted the orientations thereof to hang at the branch connection base. The branch connection base, having a tubular configuration, has a plurality of first limitation indentions and a plurality of connection slots. The branch shaft unit has a metal shaft, wherein a connecting end portion of the shaft is bent to form a hook connector, wherein tree leaves are provided at the shaft. The hook connector passes through the first limitation indentions, the second limitation indentions, and the connection slots to hang the branch shaft unit at the branch connection base. The connection structure provides an ease of assembling, high production efficiency, low manufacturing cost, reliable connection, detaching prevention, and adjustment of the orientation of the branch.

2 Claims, 5 Drawing Sheets

ARTIFICIAL CHRISTMAS TREE CONNECTION STRUCTURE

BACKGROUND OF THE PRESENT INVENTION

1. Field of Invention

The present invention relates to an artificial Christmas tree, and more particular to an artificial Christmas tree connection structure.

2. Description of Related Arts

Christmas is one of the most important festivals in the world. During the Christmas season, people would like to place a Christmas tree at home or in the public places, with lights decoration and other accessories to add to festive atmosphere. Accordingly, the artificial Christmas tree comprises a plurality of branch connectors to connect the branches with the trunk. For the conventional Christmas tree, the branch connectors are made of metal and riveted to the trunk, wherein each branch connector comprises a plurality of connecting seats outwardly protruded from a circular base seat and a transverse member riveted to each connecting seat for connecting the branches. However, such branch connection configuration is relatively complicated in operation, and the assembling efficiency of the branch connection is low. Thus, the manufacturing cost of the artificial Christmas tree incorporating with the branch connectors is relatively high.

SUMMARY OF THE PRESENT INVENTION

The invention is advantageous in that it provides an artificial Christmas tree connection structure which provides an ease of assembling, high production efficiency, low manufacturing cost, a reliable connection, accidentally detaching prevention, and a selectively adjustment of the orientation of the branch.

Another advantage of the invention is to provide an artificial Christmas tree connection structure which comprises a branch connection base and a plurality of branch shaft units, wherein the branch connection base is coupled at the tubular main trunk body while the branch shaft units are selectively adjusted the orientation to hang at the branch connection base.

The branch connection base has a tubular configuration as a hollow member, wherein a plurality of spaced apart first limitation indentions are evenly formed at an upper edge of the surrounding wall of the branch connection base, wherein a plurality of connection slots are aligned with and positioned below the first limitation indentions respectively.

The upper portion of the branch connection base has a diameter larger than an outer diameter of the tubular main trunk body. The lower portion of the branch connection base is reduced its diameter size inwardly to form a tubular connection socket to coaxially couple with the tubular main trunk body.

A ring shaped retention member is inwardly, horizontally, and radially extended from an inner wall of the surrounding wall of the branch connection base, wherein an inner slot is defined within an inner circular edge of the retention member, wherein a diameter of the inner slot is configured corresponding to the outer diameter of the tubular main trunk body. A plurality of second limitation indentions are spacedly formed at the inner circular edge of the retention member, wherein the second limitation indentions are aligned with and positioned between the first limitation indentions and the connection slots.

Each of the first and second limitation indentions is a U-shaped indention to define an inner curved surface.

The diameter of the inner slot is slightly larger than the outer diameter of the tubular main trunk body.

The branch shaft unit comprises a shaft made of elongated metal, wherein a connecting end portion of the shaft of the branch shaft unit is bent to form a hook connector, wherein tree leaves are provided at the shaft of the branch shaft unit.

The bending angle of the hook connector can be selectively adjusted by external force.

The hook connector passes through the first limitation indention, the second limitation indention, and the connection slot orderly to detachably hang the branch shaft unit at the branch connection base.

The advantages of the present invention are that the connection structure highly improves the assembling efficiency of the artificial tree, enhances the reliability of the branch connection of the artificial tree, and substantially reduces the manufacturing cost of the artificial tree incorporating with the connection structure. During the assembly of the artificial tree, the branch connection base is coaxially and slidably coupled at the tubular main trunk body until the branch connection base is secured at the tubular main trunk via the protrusion and indention engagement. Then, the branch shaft units are hung at each of the branch connection bases. The orientation of the branch shaft unit is adjusted at its desired angle and is fixed via a tool, so that the installation is completed. Therefore, the present invention provides an ease of assembling, high production efficiency, low manufacturing cost, a reliable connection, prevention of the branch shaft unit accidentally detaching from the branch connection base, a selectively adjustment of the orientation of the branch, and a rapid installation and disassembling operation.

DETAILED DESCRIPTION OF THE PREFERRED EMBODIMENT

Figure 1:
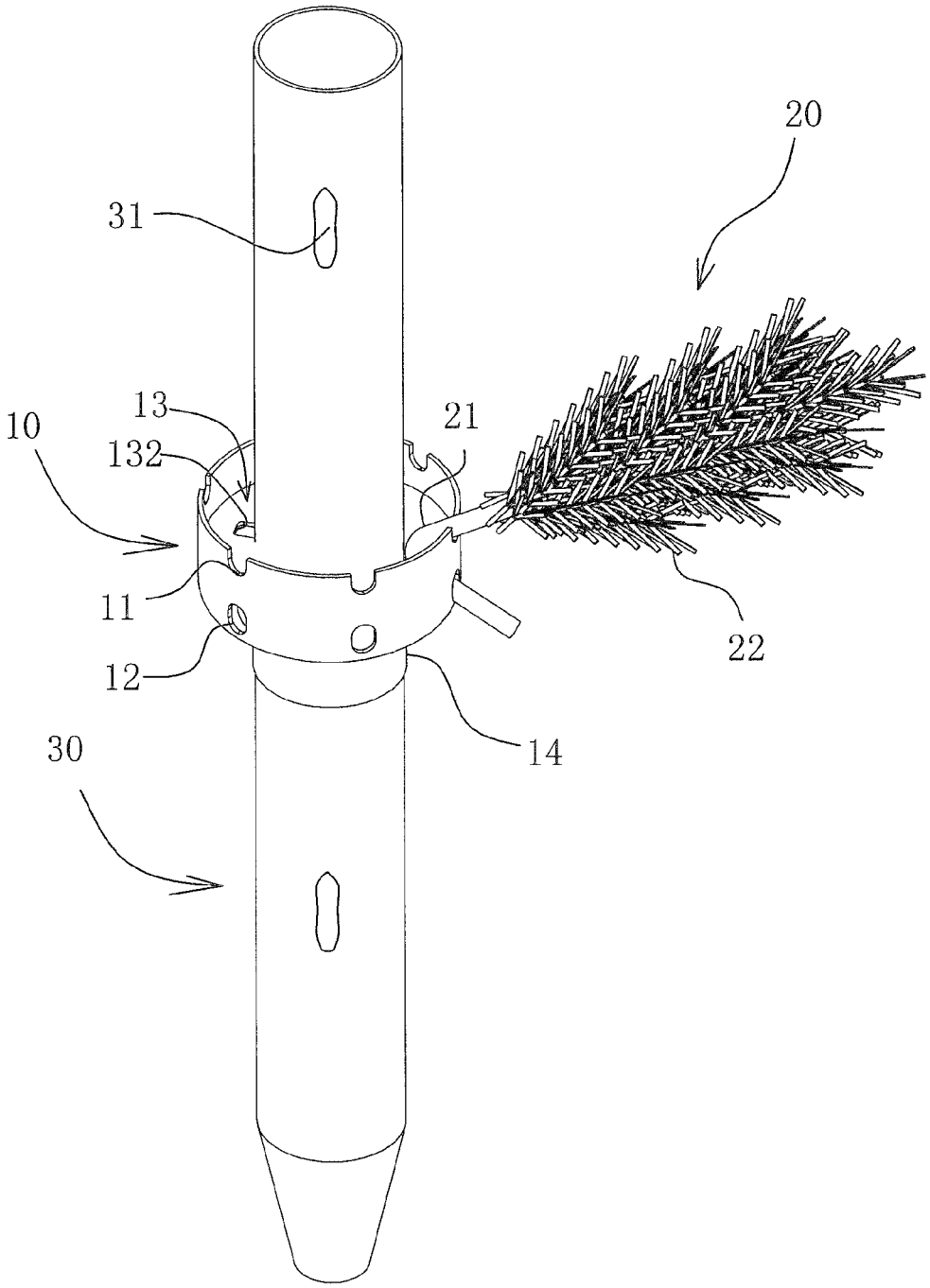
FIG. 1 is a perspective view of an artificial Christmas tree connection structure according to a preferred embodiment of the present invention.

One skilled in the art will understand that the embodiment of the present invention as shown in the drawings and described below is exemplary only and not intended to be limiting.

Figure 5:
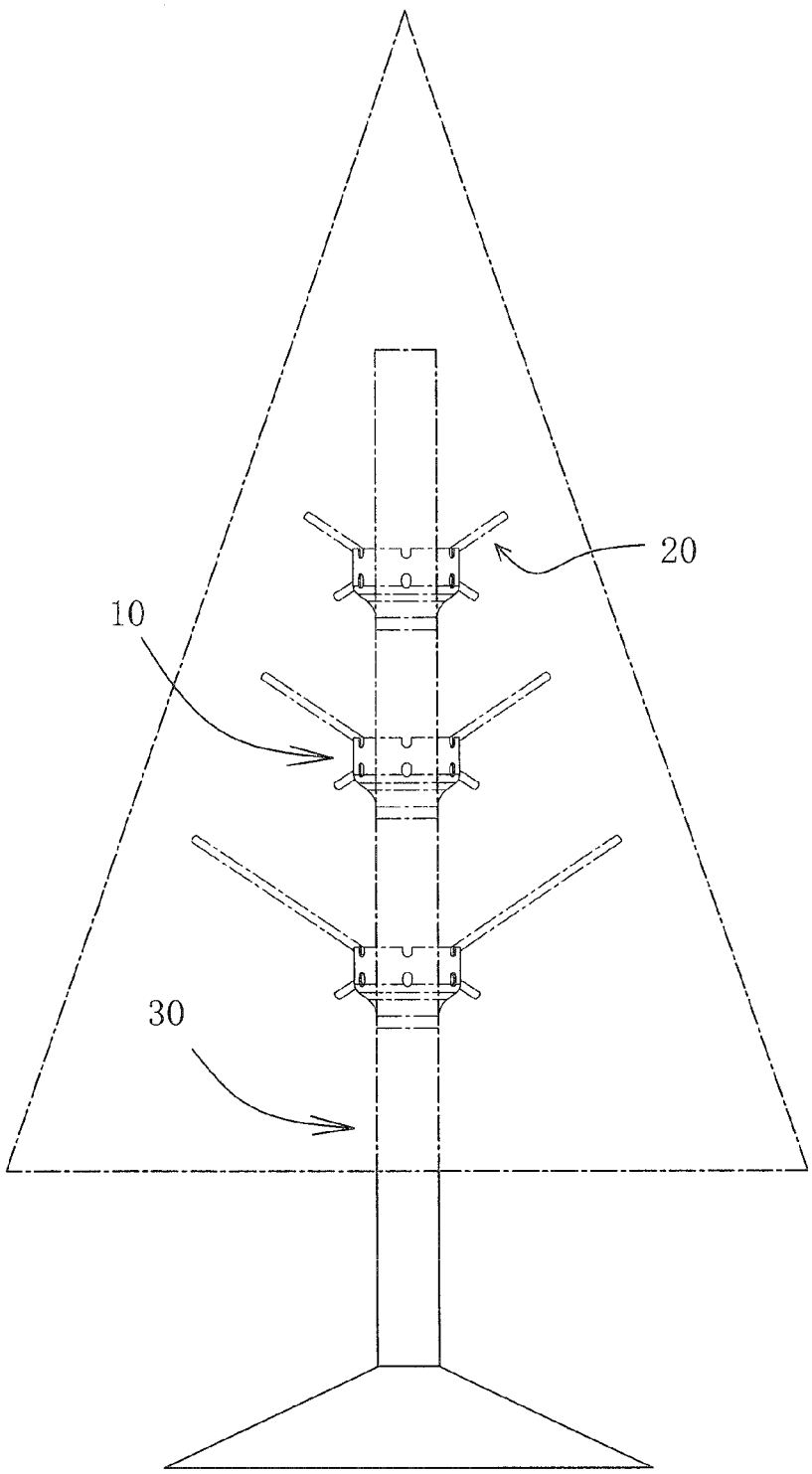
FIG. 5 illustrates and artificial Christmas tree incorporating with the artificial Christmas tree connection structure according to the preferred embodiment of the present invention.

Referring to FIG. 1 of the drawings, the present invention provides an artificial tree connection structure for an artificial tree such as an artificial Christmas tree, wherein the connection structure comprises a branch connection base 10 and a plurality of branch shaft units 20. The branch connection base 10 is coupled at a tubular main trunk body 30 by coaxially and slidably engaging the branch connection base 10 with the tubular main trunk body 30. The branch shaft units 20 are selectively adjusted the orientations thereof to hang at the branch connection base 10 so as to form the artificial Christmas tree as shown in FIG. 5.

Figure 2:
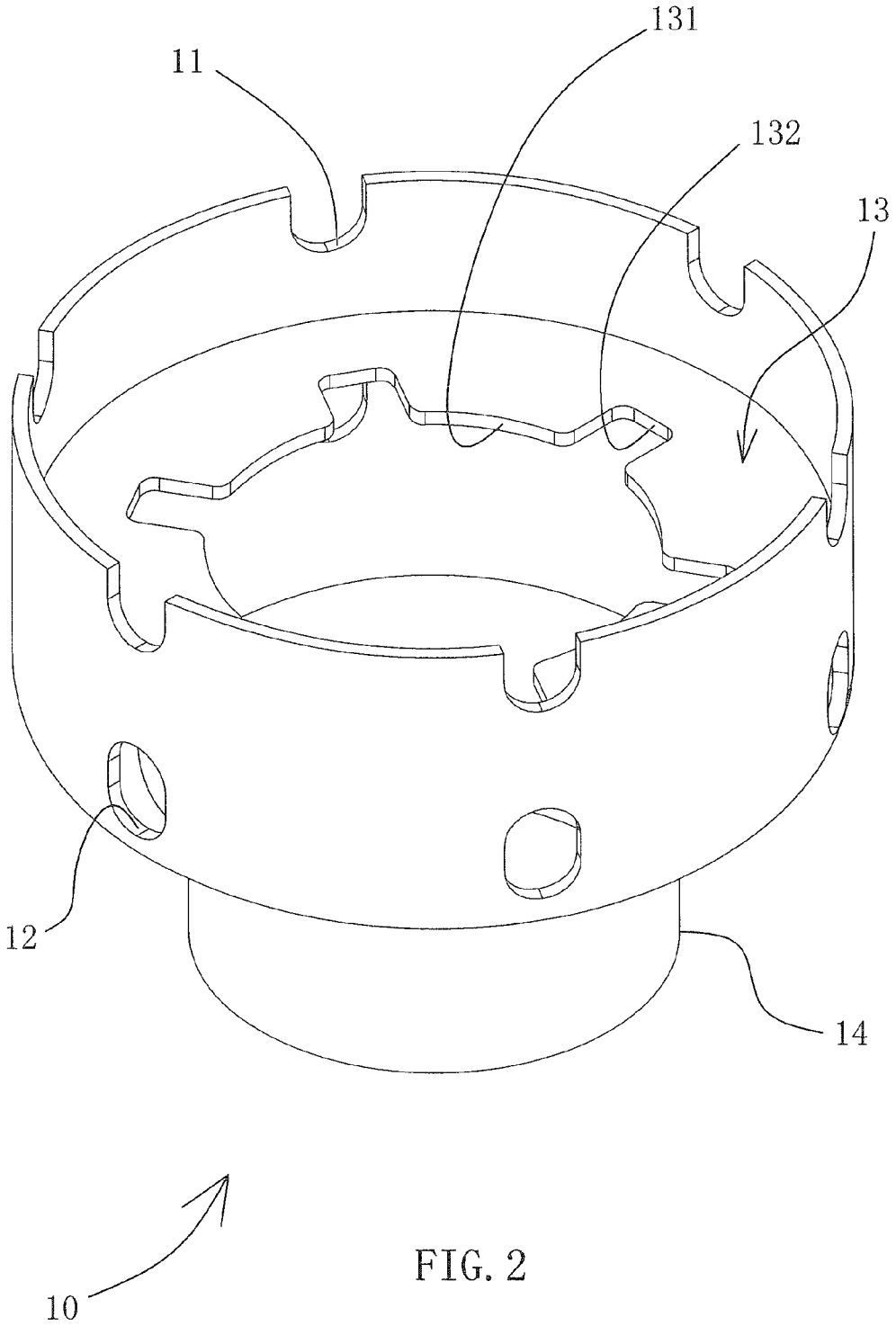
FIG. 2 is a perspective view of a branch connection base of the artificial Christmas tree connection structure according to the preferred embodiment of the present invention.
Figure 3:
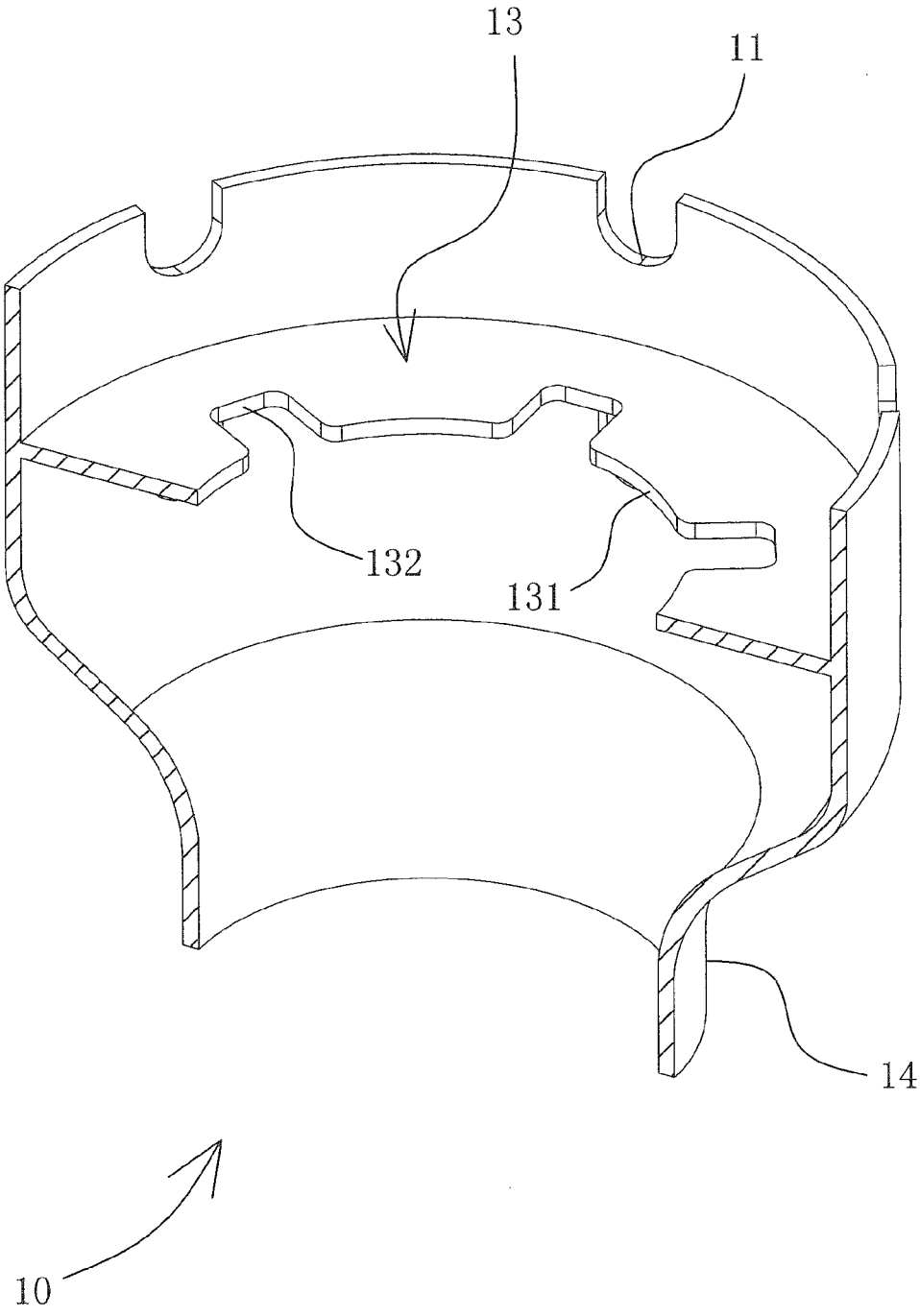
FIG. 3 is a sectional perspective view of a branch connection base of the artificial Christmas tree connection structure according to the preferred embodiment of the present invention.

As shown in FIGS. 2 and 3, the branch connection base 10 has a tubular configuration as a hollow member to define a surrounding wall, wherein the branch connection base 10 can be made of metal such as aluminum, stainless steel, and cast iron, or plastic materials. According to the preferred embodiment, the branch connection base 10 is made by mold stretching technology to stretch a tubular iron. The branch connection base 10 has six spaced apart first limitation indentions 11 evenly formed at an upper edge of the surrounding wall of the branch connection base 10 with respect to an array of the branches, wherein each of the first limitation indentions 11 is a U-shaped indention that the inner bottom surface of the first limitation indention 11 is a curved surface for matching with the corresponding branch shaft unit 20. The branch connection base 10 further has a plurality of connection slots 12 formed at the surrounding wall, wherein the connection slots 12 are aligned with and positioned below the first limitation indentions 11 respectively. Each of the connection slots 12 has a vertically oval configuration, wherein the upper and lower ends of the connection slot 12 form in an arc shape matching with the corresponding branch shaft unit 20 so as to facilitate the branch shaft unit 20 coupling with the connection slot. An upper portion of the branch connection base 10 has a diameter larger than an outer diameter of the tubular main trunk body 30. A lower portion of the branch connection base 10, i.e. from the mid-portion thereof, is reduced its diameter size inwardly to form a tubular connection socket 14, wherein the diameter of the tubular connection socket 14 is slightly larger than the outer diameter of the tubular main trunk body 30. Therefore, the tubular main trunk body 30 can slidably insert through the tubular connection socket 14 to couple the branch connection base 10 with the tubular main trunk body 30, while the branch connection base 10 can be selectively and adjustably slid along the tubular main trunk body 30 to adjust the position of the branch connection base 10. The branch connection base 10 further comprises a retention member 13 inwardly and radially extended from an inner wall of the surrounding wall of the branch connection base 10, wherein the retention member 13 has a ring shape and is extended horizontally to perpendicularly extend from the surrounding wall. The retention member 13 is extended from the surrounding wall at a positioned between the first limitation indentions 11 and the connection slots 12. The ring shaped retention member 13 forms an inner slot 131 defined within an inner circular edge of the retention member 13, wherein a diameter of the inner slot 131 is slightly larger than the outer diameter of the tubular main trunk body 30, such that the tubular main trunk body 30 can be slidably inserted through the inner slot 131 so as to couple the branch connection base 10 with the tubular main trunk body 30. The retention member 13 further has a plurality of second limitation indentions 132 spacedly formed at the inner circular edge of the retention member 13, wherein the second limitation indentions 132 are aligned with and positioned between the first limitation indentions 11 and the connection slots 12. Each of the second limitation indentions 132 is a U-shaped indention indented from inner circular edge that the inner surface of the second limitation indention 132 is a curved surface for matching with the corresponding branch shaft unit 20. Accordingly, the connection structure of the present invention provides a three-point connection to couple the branch shaft units 20 with the branch connection base 10 through the first limitation indentions 11, the connection slots 12, and the second limitation indentions 132, wherein the assembling of the connection structure is quick and easy, and is able to securely couple the branch shaft units 20 with the branch connection base 10.

As shown in FIG. 1, the tubular main trunk body 30 is a metal tube, wherein four indented slots 31 are symmetrically formed at the outer wall of the tubular main trunk body 30. After the branch connection base 10 is slidably coupled at the tubular main trunk body 30, the corresponding protrusions formed at the tubular connection socket 14 of the branch connection base 10 will engage with the indented slot 31. Accordingly, the protrusions are formed at the tubular connection socket 14 preferably by punching machine. Therefore, through the engagement between the protrusion and the indented slot 31, the branch connection base 10 can be securely coupled at the tubular main trunk body 30.

Figure 4:
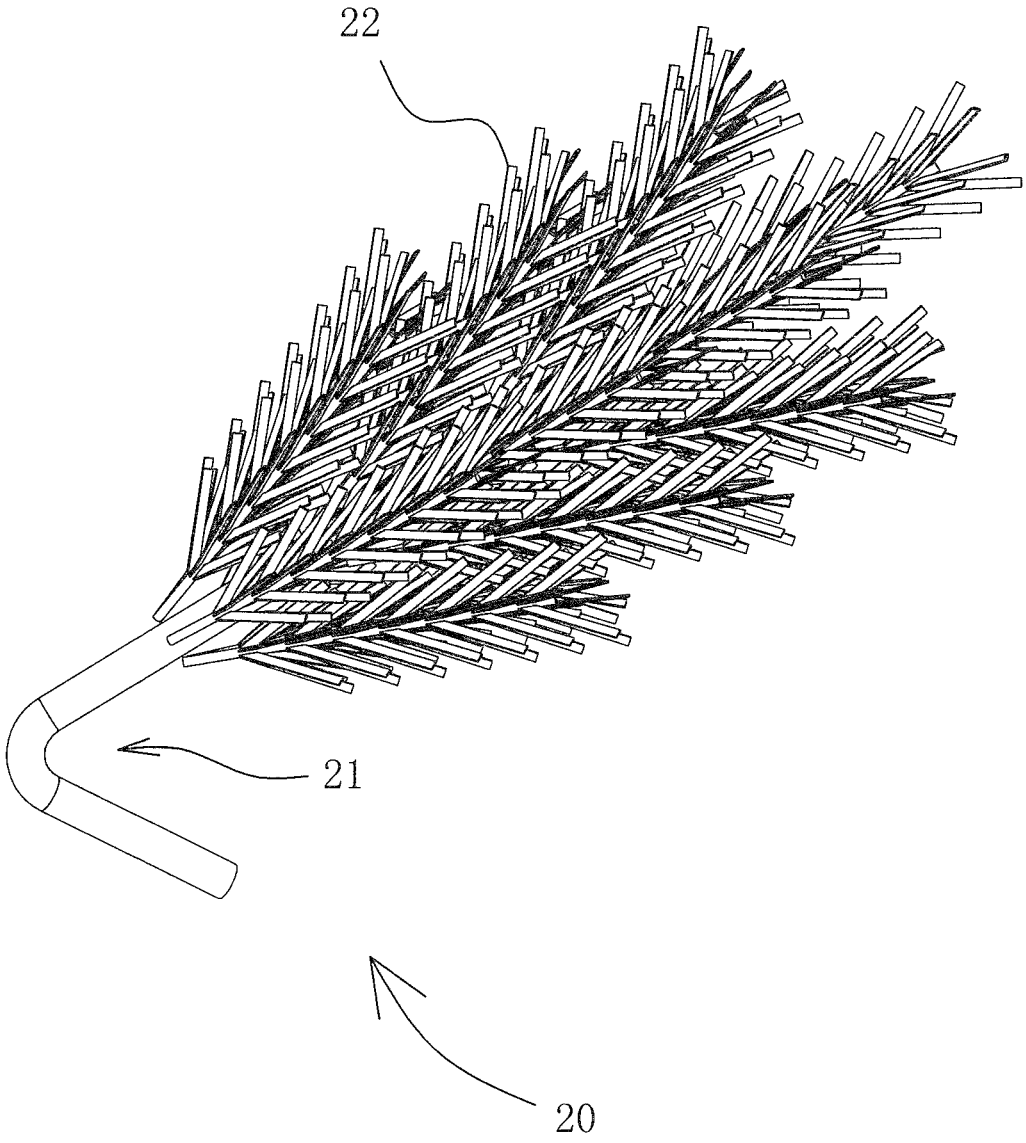
FIG. 4 is a perspective view of a branch shaft unit of the artificial Christmas tree connection structure according to the preferred embodiment of the present invention.

As shown in FIG. 4, each of the branch shaft units 20 comprises a shaft made of elongated metal. According to the preferred embodiment, the shaft of the branch shaft unit 20 is made by a metal wire with 3 mm diameter. A connecting end portion of the shaft of the branch shaft unit 20 is bent to form a hook connector 21, wherein the hook connector 21 passes through the first limitation indention 11, the second limitation indention 132, and the connection slot 12 orderly to detachably hang the branch shaft unit 20 at the branch connection base 10. The bending angle of the hook connector 21 can be selectively adjusted by external force via a tool, such as pliers. Therefore, the orientation of the branch shaft unit 20 can be horizontally extended from the branch connection base 10 or can be inclinedly extended from the branch connection base 10 through the bending angle adjustment. The length of the branch shaft unit 20 can be selectively adjusted according to the size and need of the tree, and the position of the branch shaft unit with respect to the tree. The branch shaft unit 20 further comprises a plurality of tree leaves 22 made of plastic as plastic pine Christmas tree leaves, affixed to the shaft. Since more than one branch connection base 10 are coupled along the tubular main trunk body 30, the branch shaft units 20 are coupled at each of the branch connection bases 10, so as to form the artificial Christmas tree as shown in FIG. 5.

As shown in FIG. 5, in order to assemble the artificial Christmas tree, the branch connection bases 10 are spacedly coupled at the tubular main trunk body 30. Then, the branch shaft units 20 with the tree leaves 22 are hung at each of the branch connection bases 10. Once the orientation of the branch shaft unit 20 is adjusted at its desired angle, the hook connector 21 of the branch shaft unit 20 can be fastened at the branch connection base 10 by tightly clamping the hook connector 21 at the branch connection base 10 via a hand tool. Accordingly, the present invention provides the connection structure for rapidly assembling the artificial Christmas tree and for enabling the orientation adjustment of the branch shaft unit 20.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An artificial Christmas tree connection structure, comprising a branch connection base and a plurality of branch shaft units, wherein said branch connection base is coupled at a tubular main trunk body, wherein each of said branch shaft units is selectively positioned to hang at said branch connection base, wherein said branch connection base has a tubular configuration as a hollow member to define a surrounding wall, wherein a plurality of spaced apart first limitation indentions are evenly formed at an upper edge of said surrounding wall of said branch connection base, wherein a plurality of connection slots are provided at said surrounding wall and are aligned with and positioned below said first limitation indentions respectively, wherein said branch connection base further comprises a retention member inwardly and radially extended from an inner wall of said surrounding wall of said branch connection base, wherein said retention member has a ring shape and is extended horizontally, wherein said retention member is extended from said surrounding wall at a position between said first limitation indentions and said connection slots, wherein said retention member forms an inner slot defined within an inner circular edge of said retention member that a diameter of said inner slot is configured corresponding to an outer diameter of said tubular main trunk body, wherein said retention member further has a plurality of second limitation indentions spacedly formed at said inner circular edge of said retention member, wherein said second limitation indentions are aligned with and positioned between said first limitation indentions and said connection slots.

2. The artificial Christmas tree connection structure, as recited in claim 1, wherein said diameter of said inner slot is slightly larger than said outer diameter of said tubular main trunk body.

* * * * *